US009282793B2

(12) United States Patent
Chen et al.

(10) Patent No.: US 9,282,793 B2
(45) Date of Patent: Mar. 15, 2016

(54) CONTROL MECHANISM OF FULL-AUTOMATIC MULTI-FOLDED UMBRELLA

(71) Applicants: Tien-Cheng Chen, Xiamen (CN); Sun-Feng Sung, Xiamen (CN)

(72) Inventors: Tien-Cheng Chen, Xiamen (CN); Sun-Feng Sung, Xiamen (CN)

(73) Assignee: XIAMEN MINGHO BROTHERS MFG CO., LTD., Xiamen, Fujian (CN)

( * ) Notice: Subject to any disclaimer, the term of this patent is extended or adjusted under 35 U.S.C. 154(b) by 32 days.

(21) Appl. No.: 14/450,328

(22) Filed: Aug. 4, 2014

(65) Prior Publication Data

US 2016/0029752 A1 Feb. 4, 2016

(51) Int. Cl.

| | |
|---|---|
| ***A45B 25/14*** | (2006.01) |
| ***A45B 19/04*** | (2006.01) |
| ***A45B 25/16*** | (2006.01) |

(52) U.S. Cl.

CPC ..... *A45B 25/143* (2013.01); *A45B 25/16* (2013.01); *A45B 19/04* (2013.01)

(58) Field of Classification Search

CPC ..... A45B 19/04; A45B 25/143; A45B 25/16
See application file for complete search history.

(56) References Cited

U.S. PATENT DOCUMENTS

| | | | | |
|---|---|---|---|---|
| 4,424,824 | A * | 1/1984 | Becher | A45B 19/04 135/20.3 |
| 6,006,477 | A * | 12/1999 | Ko | A45B 19/04 135/25.4 |
| 6,170,498 | B1 * | 1/2001 | Wu | A45B 19/04 135/22 |
| 6,543,464 | B1 * | 4/2003 | Grady, II | A45B 25/14 135/20.3 |
| 7,735,498 | B2 * | 6/2010 | You | A45B 25/143 135/24 |
| 7,909,049 | B2 * | 3/2011 | Yang | A45B 19/04 135/20.3 |
| 8,276,606 | B2 * | 10/2012 | Chen | A45B 19/04 135/22 |
| 8,757,183 | B2 * | 6/2014 | Volin | A45B 25/143 135/20.3 |
| 8,757,184 | B1 * | 6/2014 | Chen | A45B 19/04 135/20.3 |
| 8,857,453 | B2 * | 10/2014 | Souma | A45B 25/143 135/20.3 |

FOREIGN PATENT DOCUMENTS

| | | | | |
|---|---|---|---|---|
| TW | EP 0518814 A2 * | 12/1992 | | A45B 25/143 |

* cited by examiner

*Primary Examiner* — David R Dunn
*Assistant Examiner* — Danielle Jackson

(57) ABSTRACT

A control mechanism of a full-automatic multi-folded umbrella includes a bolt, a nut and a push rod disposed on the bolt and cooperating with the bolt. The push rod is connected with the nut and the top end of the middle sleeve. The lower end of the bolt is driven by a power source in the umbrella handle to turn clockwise or counterclockwise for the nut to be moved up and down along the bolt. The power source is controlled by a button on the umbrella handle. An umbrella opening/closing transformation ratio mechanism composed of two or three pull ropes is connected with each sleeve of a middle rod set as well as an upper nest and a lower nest to fold or unfold the umbrella.

13 Claims, 21 Drawing Sheets a-a c-c d-d

CONTROL MECHANISM OF FULL-AUTOMATIC MULTI-FOLDED UMBRELLA

BACKGROUND OF THE INVENTION

1. Field of the Invention

The present invention relates to a control mechanism of a full-automatic multi-folded umbrella which can be controlled to open/close automatically.

2. Description of the Prior Art

In these days, the climate is constantly changing so people are used to take an umbrella along to prevent a heavy rain unexpectedly. But, the frame of a conventional umbrella has to be pushed to a specific position to unfold the umbrella. Once there is a sudden downpour, the user may be wet because he/she cannot unfold the umbrella quickly. Therefore, an improved umbrella is developed. The umbrella handle is provided with a button. The user just presses the button to unfold the umbrella automatically. But, this kind of umbrella doesn't have the function to fold the umbrella automatically. When the user gets in the car, he/she has to fold the umbrella with both hands. In such a short time, the user is always wet. This umbrella is inconvenient for use.

Chinese Utility Model Publication No. CN2476208Y published on Feb. 13, 2002 discloses a control device for an automatic umbrella. The working principle of this umbrella is that when the umbrella is unfolded, the button is pressed and the control device releases the middle rod of the umbrella. The middle rod is biased by the springs inside the middle rod to extend upward so as to unfold the umbrella. When the user wants to fold the umbrella, the button is pressed again for the control device to release the buckle inside the middle rod. The springs on the frame urges the umbrella to be folded. The buckle is pulled by the pull rope to the top of the middle rod. At this moment, the umbrella is not fully folded. The user has to push a portion of the umbrella toward the handle to shorten the middle rod. The springs are restored to energize, and the middle rod and the buckle are controlled by the control device in the handle again. Thus, the umbrella is folded completely.

The operation principle of the existing full-automatic umbrella is substantially identical to that of the aforesaid patent, such as Chinese Utility Model Application numbers 01217730.X, 01237609.4, 01262761.5, 03267824.X. The difference between them is the control device inside the handle to control the middle rod and the buckle.

Thus, the existing automatic umbrella can be unfolded automatically and folded semi-automatically. It cannot be completely folded to its original state to achieve a full automatic function. The umbrella is completely folded by applying a force. The present invention is to solve the problem how to fold/unfold the umbrella automatically by controlling the handle. Accordingly, the inventor of the present invention has devoted himself based on his many years of practical experiences to solve these problems.

SUMMARY OF THE INVENTION

The primary object of the present invention is to provide a control mechanism of a full-automatic multi-folded umbrella to open/close the umbrella completely.

In order to achieve the aforesaid object, the control mechanism of the present invention is disposed between an umbrella handle and a middle rod set for controlling an umbrella opening/closing transformation ratio mechanism. The middle rod set comprises at least three sleeves, an outer sleeve, a middle sleeve and an inner sleeve. The top end of the middle rod set is connected with an upper nest. A lower nest is fitted on the middle rod set. The control mechanism comprises a bolt, a nut and a push rod disposed on the bolt and cooperating with the bolt. The push rod is connected with the nut and the top end of the middle sleeve. The lower end of the bolt is driven by a power source in the umbrella handle to turn clockwise or counterclockwise for the nut to be moved up and down along the bolt. The power source is controlled by a button on the umbrella handle.

Preferably, the upper end of the outer sleeve of the middle rod set is provided with an outer sleeve pulley. An outer sleeve fixing ring is fixed to the lower end of the outer sleeve to cooperate with the outer sleeve. The outer sleeve plug has a central through hole. A middle sleeve plug having a middle sleeve pulley is fixed to the top end of the middle sleeve. A middle sleeve fixing ring is fixed to the lower end of the middle sleeve. An outer side of the middle sleeve fixing ring is provided with a middle sleeve fixing ring pulley. The lower end of the inner sleeve is fixed to the umbrella handle.

Preferably, the middle sleeve plug is made of a plastic material. The middle sleeve plug has a hanging hole to cooperate with the push rod. The hanging hole is provided with a metallic ring therein. The middle sleeve plug further has a fixing hole to fix a full rope and cooperate with a metallic pipe. The metallic pipe has a guide curved edge at one end surface thereof.

Preferably, an outer sleeve plug is fixed inside the upper end of the outer sleeve. The outer sleeve plug has a central through hole. An outer sleeve pulley is provided at the upper portion of the outer sleeve plug. The outer sleeve is formed with a notch corresponding in position to the outer sleeve pulley.

Preferably, an inner sleeve plug is fixed to the top portion of the inner sleeve. The inner sleeve plug is made of a plastic material. The inner sleeve plug has a fixing hole for insertion of a pull rope and cooperating with a metallic pipe having a guide curved edge at one end surface thereof.

Preferably, one side wall of the inner sleeve plug is directly formed with a trough to cooperate with the upper end of the inner sleeve so as to form a receiving space for a concave point of the inner sleeve.

Preferably, the lower end of the bolt is provided with a soft cushion located above the power source.

Preferably, the upper nest is secured to the top end of the outer sleeve. The lower portion of the upper nest is fitted on the outer sleeve and formed with a lid groove corresponding in position to a notch of the outer sleeve.

Preferably, the lower end of the upper nest is connected with an auxiliary spring fitted on the outer sleeve.

Preferably, the push rod is a pair of symmetrical hard rod members, and two sides of the inner sleeve plug are formed with guide grooves.

Preferably, the push rod is a hard pipe.

Preferably, the power source is a motor.

Preferably, the umbrella opening/closing transformation ratio mechanism comprises a lower nest pull rope, a transformation ratio pull rope, and an inner sleeve pull rope. One end of the lower nest pull rope is fixed to the middle sleeve plug. The other end of the lower nest pull rope passes through the outer sleeve and winds though the outer sleeve pulley to be fixed to the lower nest. One end of the transformation ratio pull rope is fixed to the upper end of the inner sleeve. The other end of the transformation ratio pull rope passes through the bottom of the middle sleeve, winds through the middle sleeve fixing ring pulley of the middle sleeve fixing ring, enters the middle sleeve to extend out of the upper end of the middle sleeve, and enters the outer sleeve to extend out of the upper end of the outer sleeve to be fixed to the top of the outer sleeve. One end of the inner sleeve pull rope is fixed to the upper end of the inner sleeve. The other end of the inner sleeve pull rope passes through the middle sleeve, winds through the middle sleeve pulley of the middle sleeve plug, and enters the position between the middle sleeve and the outer sleeve to be fixed to the lower end of the outer sleeve.

Preferably, the transformation ratio rope and the inner sleeve pull rope are the same rope.

Preferably, the umbrella opening/closing transformation ratio mechanism comprises a lower nest pull rope and a middle sleeve pull rope. One end of the lower nest pull rope is connected to the middle sleeve plug. The other end of the lower nest pull rope passes through the outer sleeve pulley and extends out of the outer sleeve to be fixed to the lower nest. One end of the middle sleeve pull rope is connected to the inner sleeve plug. The other end of the middle sleeve pull rope passes through the middle sleeve pulley of the middle sleeve plug to be fixed to the lower end of the outer sleeve.

Through the umbrella opening/closing transformation ratio mechanism, the control mechanism of the present invention can fold or unfold the umbrella automatically.

To unfold the umbrella, the button of the umbrella handle is pressed to start the power source to output a power to turn clockwise. The nut is moved upward along the bolt. When the nut is moved upward, thee push rod is moved to bring the middle sleeve to move upward relative to the middle sleeve. The distance between the middle sleeve plug and the upper end of the inner sleeve is lengthened. The inner sleeve pull rope will pull the outer sleeve fixing ring to move upward relative to the middle sleeve to supplement the change of the distance, namely, the outer sleeve is pushed to unfold relative to the middle sleeve. At this moment, the distance between the outer sleeve plug and the middle sleeve plug is lengthened. The lower nest pull rope will pull the lower nest to move upward relative to the outer sleeve to supplement the change of the distance. The lower nest is moved upward to unfold the frame. In this way, the umbrella is unfolded completely. To fold the umbrella, the button of the umbrella handle is pressed again to start the power source to output a power to turn reversely. The nut will be moved downward along the bolt. When the nut is moved downward, the push rod is pushed to bring the middle sleeve to move downward relative to the inner sleeve. At the same time, the lower nest pull rope connected on the middle sleeve plug will pull the lower nest to move upward relative to the outer sleeve. The umbrella frame is folded by the function of the springs and the umbrella cloth.

Alternatively, to unfold the umbrella, the button of the umbrella handle is pressed to start the power source to output a power to turn clockwise. The power source will drive the bolt to turn, and the nut will be moved upward along the bolt. When the nut is moved upward, the bolt will use the push rod to push the middle sleeve plug to move the middle sleeve upward. The middle sleeve is pushed to unfold upward relative to the inner sleeve. The other end of the middle sleeve pull rope will pull the outer sleeve to move upward relative to the middle sleeve to supplement the change of the distance, namely, the outer sleeve is pushed to unfold relative to the middle sleeve. At this moment, the distance between the outer sleeve plug and the middle sleeve plug is lengthened. The lower nest pull rope will pull the lower nest to move upward relative to the outer sleeve to supplement the change of the distance. The lower nest is moved upward to unfold the umbrella frame completely. To fold the umbrella, the button of the umbrella handle is pressed again to start the power source to output a power to turn reversely. The power source will drive the bolt to turn reversely, and the nut will be moved downward along the bolt. When the nut is moved downward, the bolt will use the push rod to bring the middle sleeve plug and the middle sleeve to move downward. The middle sleeve is moved downward relative to the inner sleeve. The middle sleeve pull rope will bring the outer sleeve to move downward relative to the middle sleeve. The umbrella frame is folded by the function of the springs and the umbrella cloth completely.

Accordingly, the middle rod set of the present invention is provided with the umbrella opening/closing transformation ratio mechanism composed of two or three pull ropes. The two or three pull ropes are connected with the sleeves of the middle rod set as well as the upper nest and the lower nest respectively, and cooperate with the power source in the umbrella handle to drive the bolt to turn. When the nut on the bolt is moved up and down, the push rod is pushed to bring the middle sleeve to move up and down relative to the inner sleeve to open/close the sleeves of the middle rod set and the umbrella cloth. The multi-folded umbrella can be folded or unfolded completely for people to use the umbrella conveniently and quickly.

BRIEF DESCRIPTION OF THE DRAWINGS

FIG. 1-1 is an exploded view showing the middle sleeve plug of the present invention;

FIG. 1-2 is a perspective view showing the middle sleeve plug and the push rod of the present invention;

FIG. 1-3 is an exploded view showing the inner sleeve plug of the present invention;

FIG. 1-4 is a perspective view showing the inner sleeve plug of the present invention;

FIG. 1-5 is a perspective view showing the bolt and the umbrella handle of the present invention;

FIG. 2 is a partially exploded view according to a first embodiment of the present invention;

FIG. 3 is a schematic view showing the umbrella of the first embodiment of the present invention in an unfolded state;

FIG. 4 is a schematic view showing the umbrella of the first embodiment of the present invention in a folded state;

FIG. 5 is a partially structural schematic view showing the umbrella of the first embodiment of the present invention in a folded state;

DETAILED DESCRIPTION OF THE PREFERRED EMBODIMENTS

Figure 1:
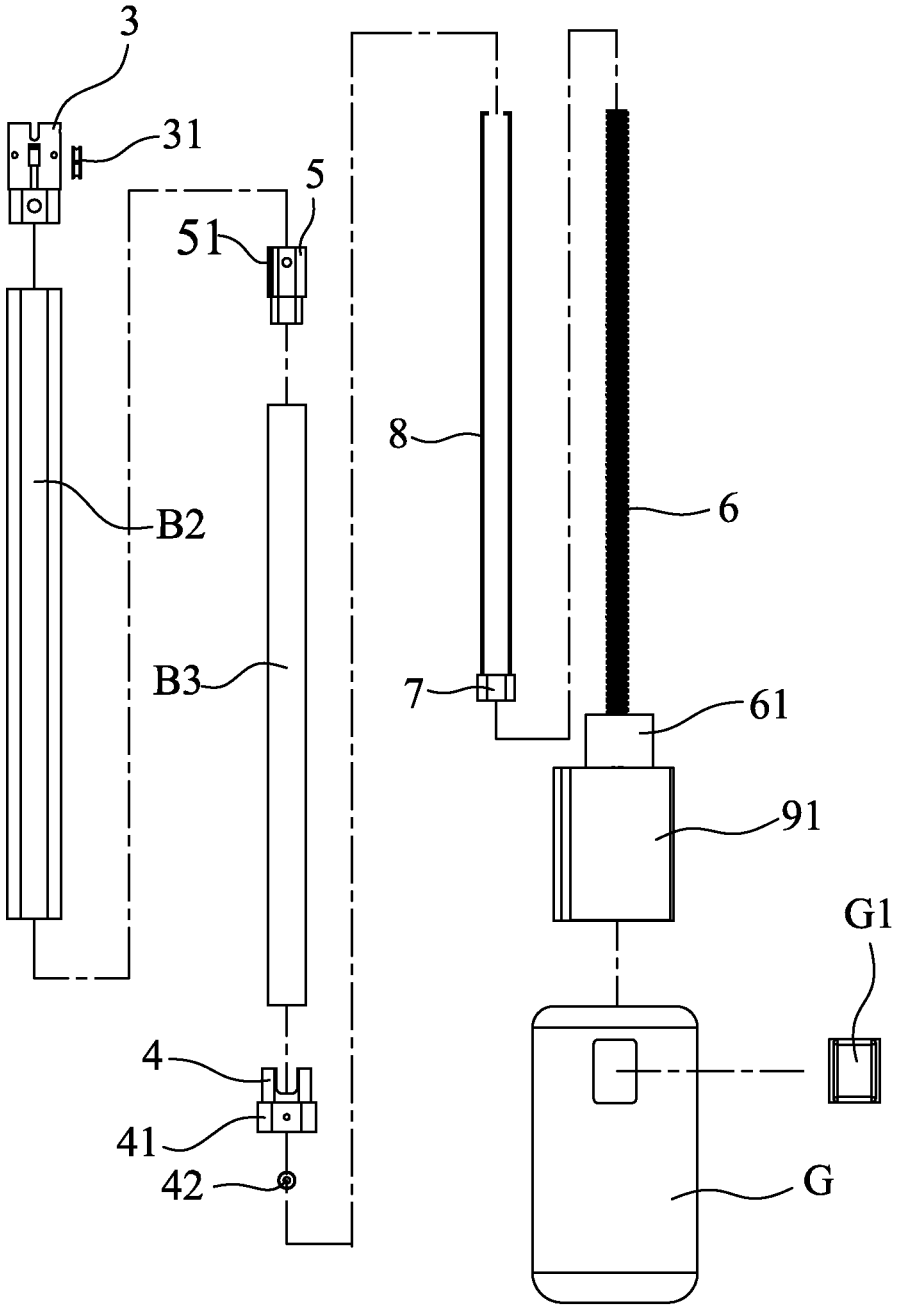
FIG. 1 is an exploded view of the present invention.
Figure 1:
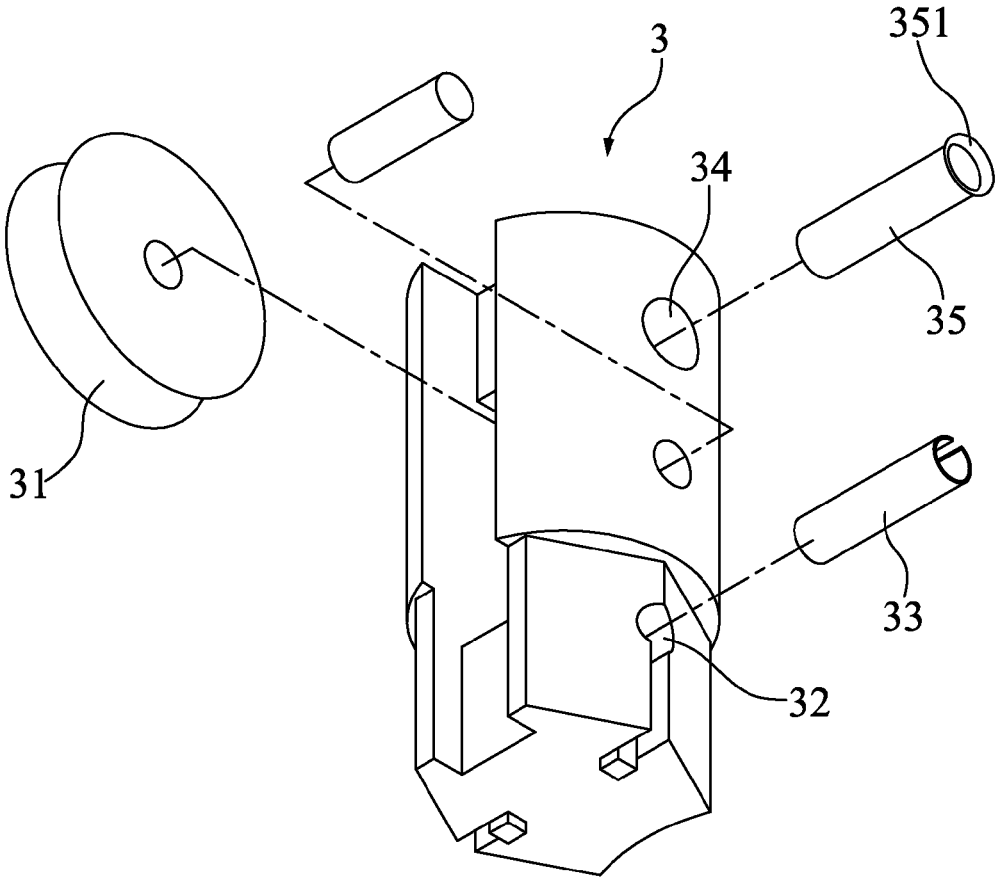

Embodiments of the present invention will now be described, by way of example only, with reference to the accompanying drawings.

As shown in FIG. 1 to FIG. 13, the present invention disclosures a control mechanism of a full-automatic multi-folded umbrella. The control mechanism is disposed between an umbrella handle G and a middle rod set B for controlling an umbrella opening/closing transformation ratio mechanism. Wherein, the control mechanism comprises a bolt 6, a nut 7 and a push rod 8 disposed on the bolt 6 and cooperating with the bolt 6. The push rod 8 is connected with the nut 7 and the top end of a middle sleeve of the middle rod set B. The lower end of the bolt 6 is connected with a power source 9 in the umbrella handle G and driven by the power source 9 to turn clockwise or counterclockwise, such that the nut 7 is moved up or down along the bolt 6. The power source 9 is disposed in the umbrella handle G, which is a motor to bring a gear set to connect to the bolt 6 or uses a mechanical drive to cooperate with a change gear set to bring the bolt 6 to turn. Alternatively, the turning shaft of the motor can cooperate with the bolt 6 directly. The power source is controlled by a button G1 on the umbrella handle G.

The present invention is applied to an umbrella. The umbrella comprises an umbrella frame A, an umbrella cloth (not shown in the drawings) secured on the umbrella frame A, an upper nest C, a lower nest D, and an umbrella opening/closing transformation ratio mechanism E.

Umbrella ribs A1 of the frame A cooperate with the corresponding upper nest C and the lower nest D, and each umbrella rib A1 is provided with a spring A2 for folding umbrella.

Referring to FIG. 2 to FIG. 13, in the embodiment of the present invention, the middle rod set B comprises at least three sleeves, an outer sleeve B1, a middle sleeve B2, and an inner sleeve B3 from top to bottom in sequence.

An outer sleeve plug 1 is fixed inside the upper end of the outer sleeve B1, and an outer sleeve fixing ring 2 is fixed to the lower end of the outer sleeve B1. The outer sleeve plug 1 has a central through hole 11. An outer sleeve pulley 12 is provided at the upper portion of the outer sleeve plug 1. The outer sleeve B1 is formed with a notch B11 corresponding in position to the outer sleeve pulley 12 for passing of a lower nest pull rope E1. The outer sleeve fixing ring 2 is an annular member. The upper portion of the outer sleeve fixing ring 2 is inserted into the outer sleeve B1, and the lower end of the outer sleeve fixing ring 2 is formed with a flange 21 protruding out of the outer sleeve B1.

A middle sleeve plug 3 is fixed to the upper end of the middle sleeve B2, and a middle sleeve fixing ring 4 is fixed to the lower end of the middle sleeve B2. The lower portion of the middle sleeve plug 3 is inserted into the middle sleeve B2. The middle portion of the middle sleeve plug 3 is provided with a middle sleeve pulley 31. The number of the middle sleeve pulley 31 may be one or more. This embodiment has one pulley. The middle sleeve fixing ring 4 is an annular member. The upper portion of the middle sleeve fixing ring 4 is inserted into the middle sleeve B2, and the lower end of the middle sleeve fixing ring 4 is formed with a flange 41 protruding out of the middle sleeve B2. One side of the flange 41 is provided with a middle sleeve fixing ring pulley 42. The middle sleeve B2 is formed with a notch corresponding in position to the middle sleeve fixing ring pulley 42 for passing of a transformation ratio pull rope E2.

An inner sleeve plug 5 is fixed to the top end of the inner sleeve B3, and the lower end of the inner sleeve B3 is fixed to the umbrella handle G.

The aforesaid three sleeves uses their respective plugs, the middle sleeve plug 3 and the inner sleeve plug 5, to cooperate with their respective fixing rings, the outer sleeve fixing ring 2 and the middle sleeve fixing ring 4, to connect with each other, such that the middle rod set B is constituted to be folded and unfolded.

The upper nest C is secured to the top end of the outer sleeve B1. The lower portion of the upper nest C is fitted on the outer sleeve B1 and formed with a lid groove C1 corresponding in position to the notch B11 of the outer sleeve B1 for passing of the lower nest pull rope E1. The lower end of the upper nest C is connected with an auxiliary spring I. When the umbrella is unfolded, the auxiliary spring I compressed by the lower nest D is in a compressed energized state.

The lower nest D is slidably fitted on the outer sleeve B1.

The umbrella handle G is a cover to accommodate the power source 9. The umbrella handle G is provided with the button G1 to switch on the clockwise/counterclockwise turning power of the power source 9.

As shown in FIG. 2 to FIG. 5, the umbrella opening/closing transformation ratio mechanism E comprises a lower nest pull rope E1, a transformation ratio pull rope E2, and an inner sleeve pull rope E3.

One end of the lower nest pull rope E1 is fixed to the top of the middle sleeve plug 3, and the other end of the lower nest pull rope E1 passes through the outer sleeve B1 and winds though the outer sleeve pulley 12 of the outer sleeve plug 1 to be fixed to the lower nest D.

One end of the transformation ratio pull rope E2 is fixed to the upper end of the inner sleeve B1. In this embodiment, it is fixed on the inner sleeve plug 5. The other end of the transformation ratio pull rope E2 passes through the notch B21 at the bottom of the middle sleeve B2, and winds through the middle sleeve fixing ring pulley 42 of the middle sleeve fixing ring 4, and enters the middle sleeve B2 to extend out of the upper end of the middle sleeve B2, and enters the outer sleeve B1 to extend out of the upper end of the outer sleeve B1 to be fixed on the outer sleeve plug 1.

One end of the inner sleeve pull rope E3 is fixed to the upper end of the inner sleeve B3. In this embodiment, it is fixed on the inner sleeve plug 5. The other end of the inner sleeve pull rope E3 passes through the middle sleeve B2, and winds through the middle sleeve pulley 31 of the middle sleeve plug 3, and enters the position between the middle sleeve B2 and the outer sleeve B1 and fixed to the lower end of the outer sleeve B1. In this embodiment, it is fixed to the flange 21 of the outer sleeve fixing ring 2.

Because one end of the middle sleeve pull rope E2 and one end of the inner sleeve pull rope E3 are fixed to the upper end of the inner sleeve B3, the transformation ratio rope E2 and the inner sleeve pull rope E3 can be the same rope.

The lower end of the push rod 8 cooperates with the nut 7. The upper end of the push rod 8 passes through the inner sleeve plug 5 and is connected on the middle sleeve plug 3. In this embodiment, the push rod 8 is a pair of symmetrical hard rod members, such as steel wires. Alternatively, the push rod 8 can be a hard pipe. Through the push rod 8, the nut 7 can bring the middle plug 3 to move up and down.

The upper end of the bolt 6 cooperates with the inner sleeve plug 5. The inner sleeve plug 5 is formed with a guide groove 51 for passing of the push rod 8. In this embodiment, two sides of the inner sleeve plug 5 are formed with guide grooves 8 to accommodate the push rod 8.

Figures 1, 2:
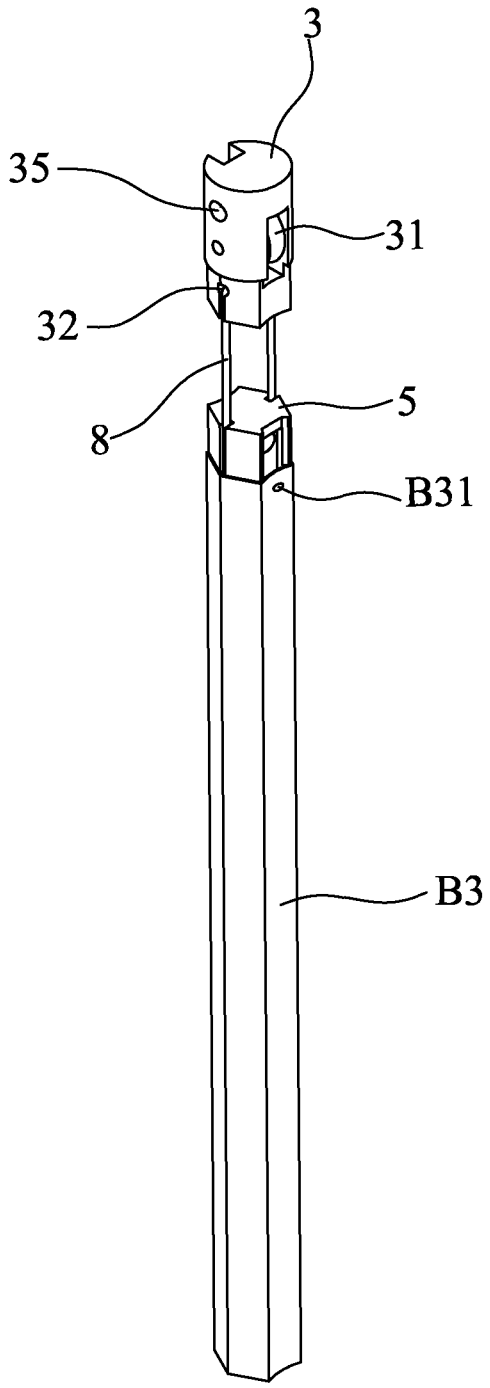
Figures 1, 2, 3:
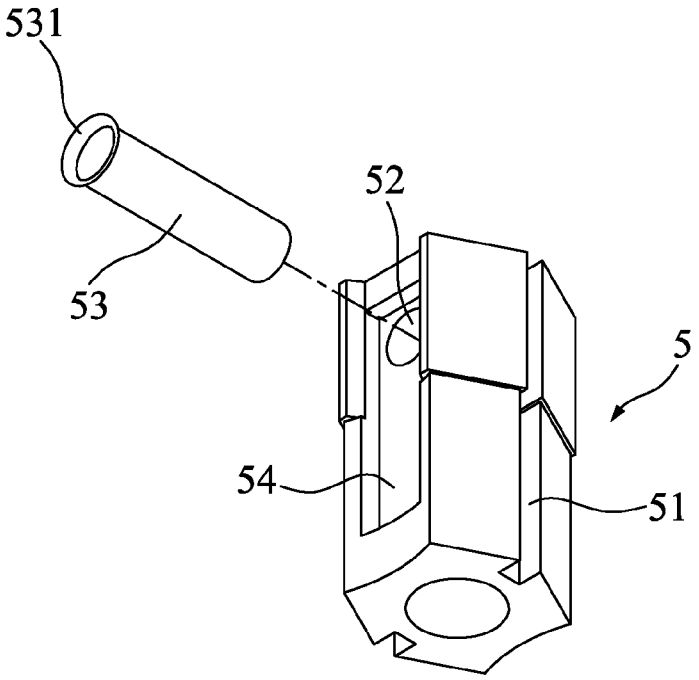
Figure 3:
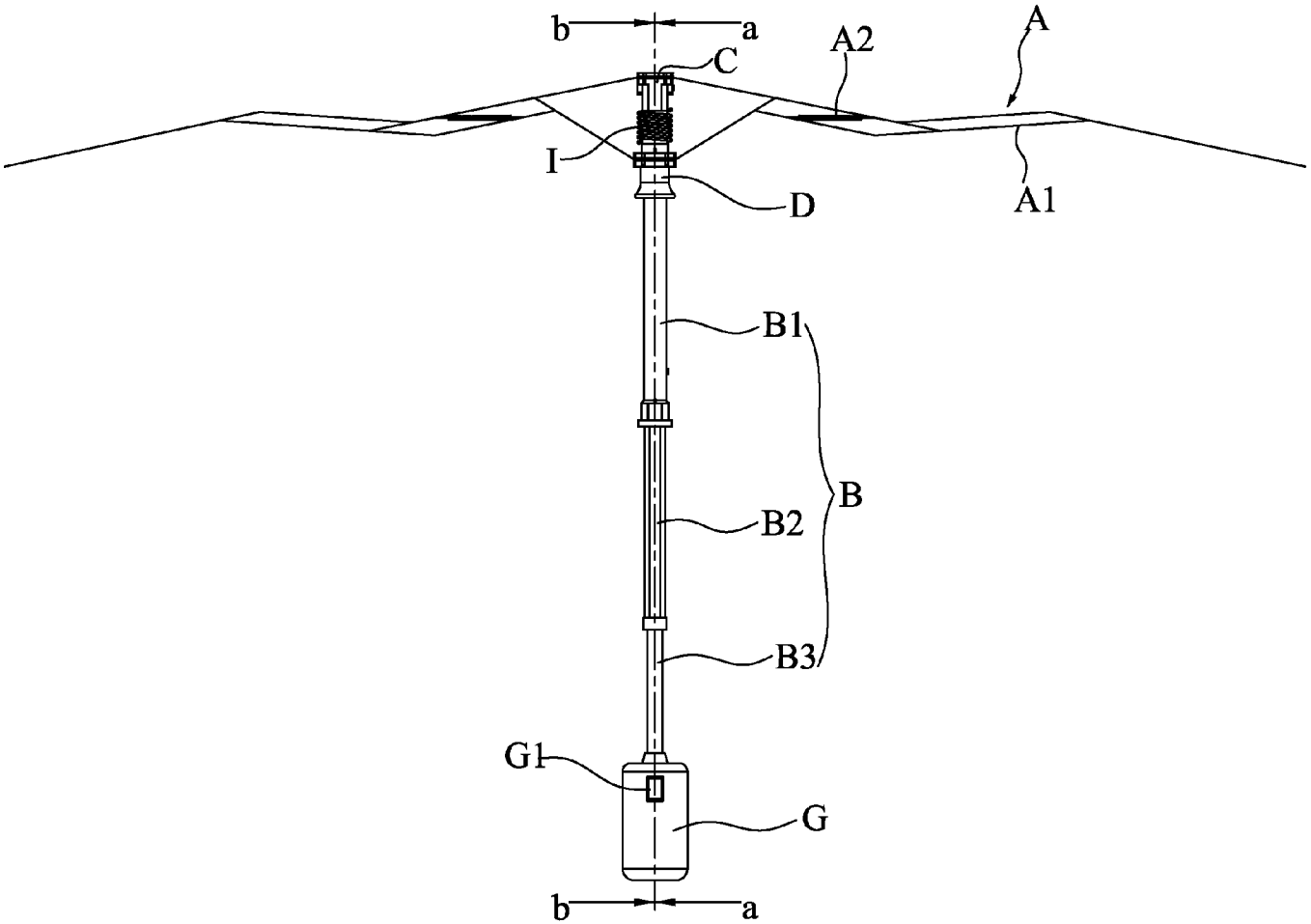
Figure 3A:
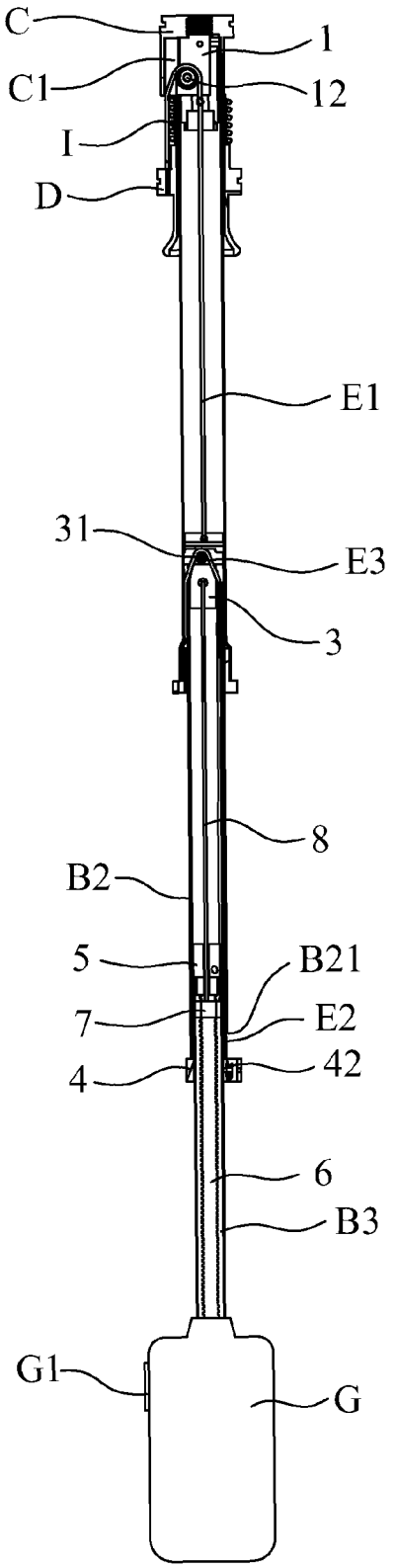
FIG. 3*a* is a sectional view taken along line a-a of FIG. 3.
Figure 3B:
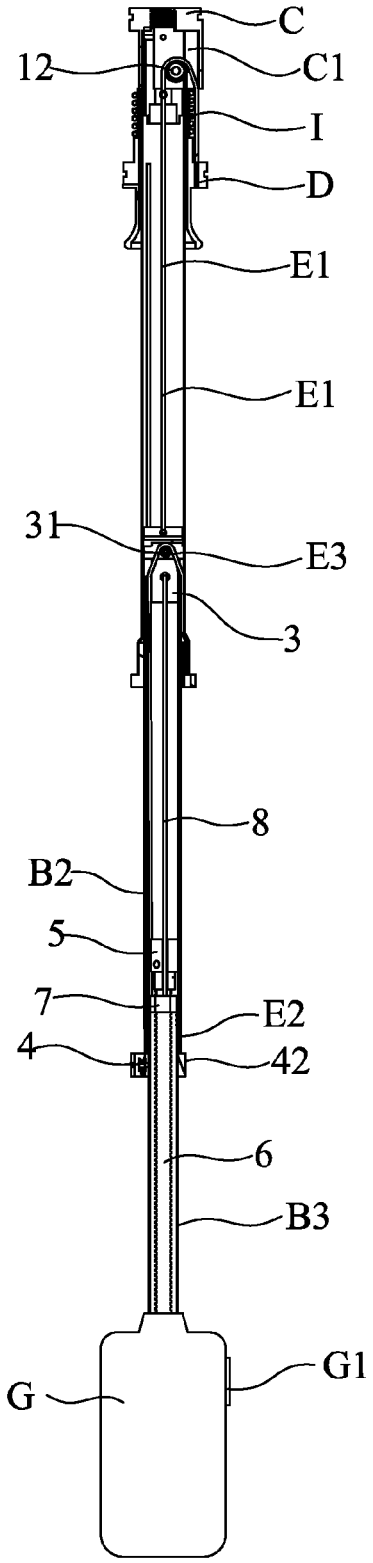
FIG. 3*b* is a sectional view taken along line b-b of FIG. 3.

As shown in FIG. 3, FIG. 3*a*, FIG. 3*b*, when the user wants to unfold the umbrella, the button G1 of the umbrella handle G is pressed to start the power source 9 to output a power to turn clockwise. The power source 9 will drive the bolt 6 to turn, and the nut 7 will be moved upward along the bolt 6. When the nut 7 is moved upward, the bolt 6 will use the push rod 8 to push the middle sleeve plug 3 to move the middle sleeve B2 upward. The middle sleeve B2 is pushed to unfold upward relative to the inner sleeve B3. When the middle sleeve B2 is moved upward, the distance between the middle sleeve plug 3 and the upper end of the inner sleeve B3 is lengthened. The inner sleeve pull rope E3 will pull the outer sleeve fixing ring 2 to move upward relative to the middle sleeve B2 to supplement the change of the distance, namely, the outer sleeve B1 is pushed to unfold relative to the middle sleeve B2. At this moment, the distance between the outer sleeve plug 1 and the middle sleeve plug 3 is lengthened. The lower nest pull rope E1 will pull the lower nest D to move upward relative to the outer sleeve B1 to supplement the change of the distance. The lower nest D is moved upward to unfold the frame A. In this way, the umbrella is unfolded completely. Subject to positioning function of the inner sleeve plug 5, the middle sleeve won't slide down relative to the inner sleeve. During the operation to unfold the umbrella, the inner sleeve pull rope E3 and the lower nest pull rope E1 are mainly to unfold the umbrella. The transformation ratio pull rope E2 is for the change of the shortened distance between the middle sleeve fixing ring 4 and the inner sleeve B3 as well as the lengthened distance between the outer sleeve plug 1 and the upper end of the inner sleeve B3.

Figures 1, 2, 3, 4:
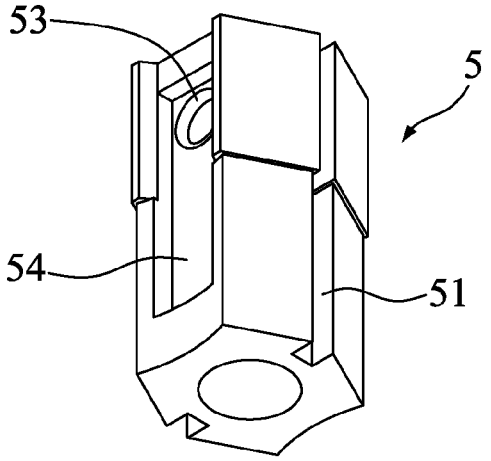
Figures 1, 2, 3, 4, 5:
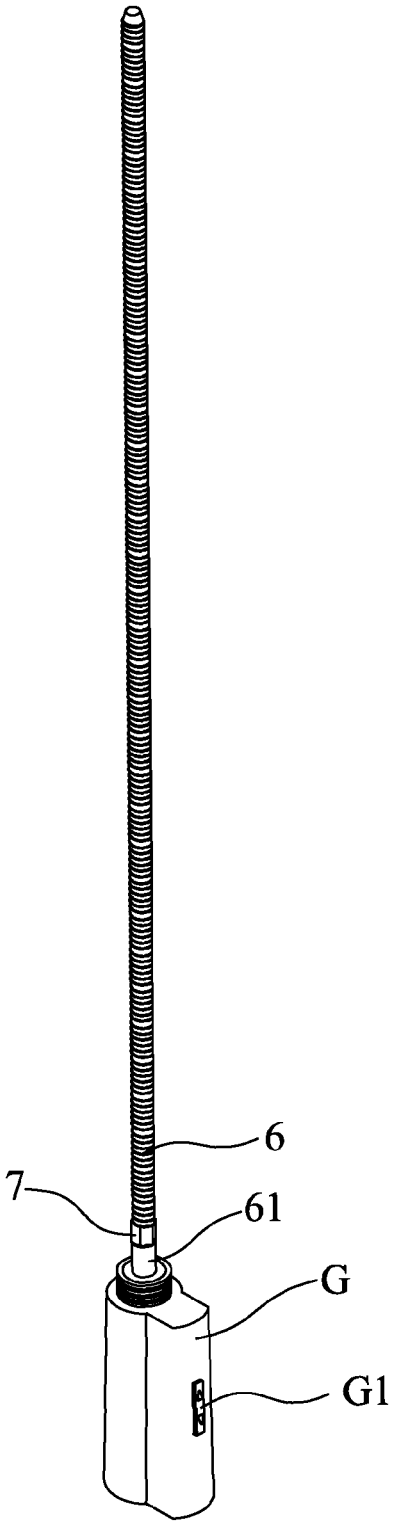
Figure 2:
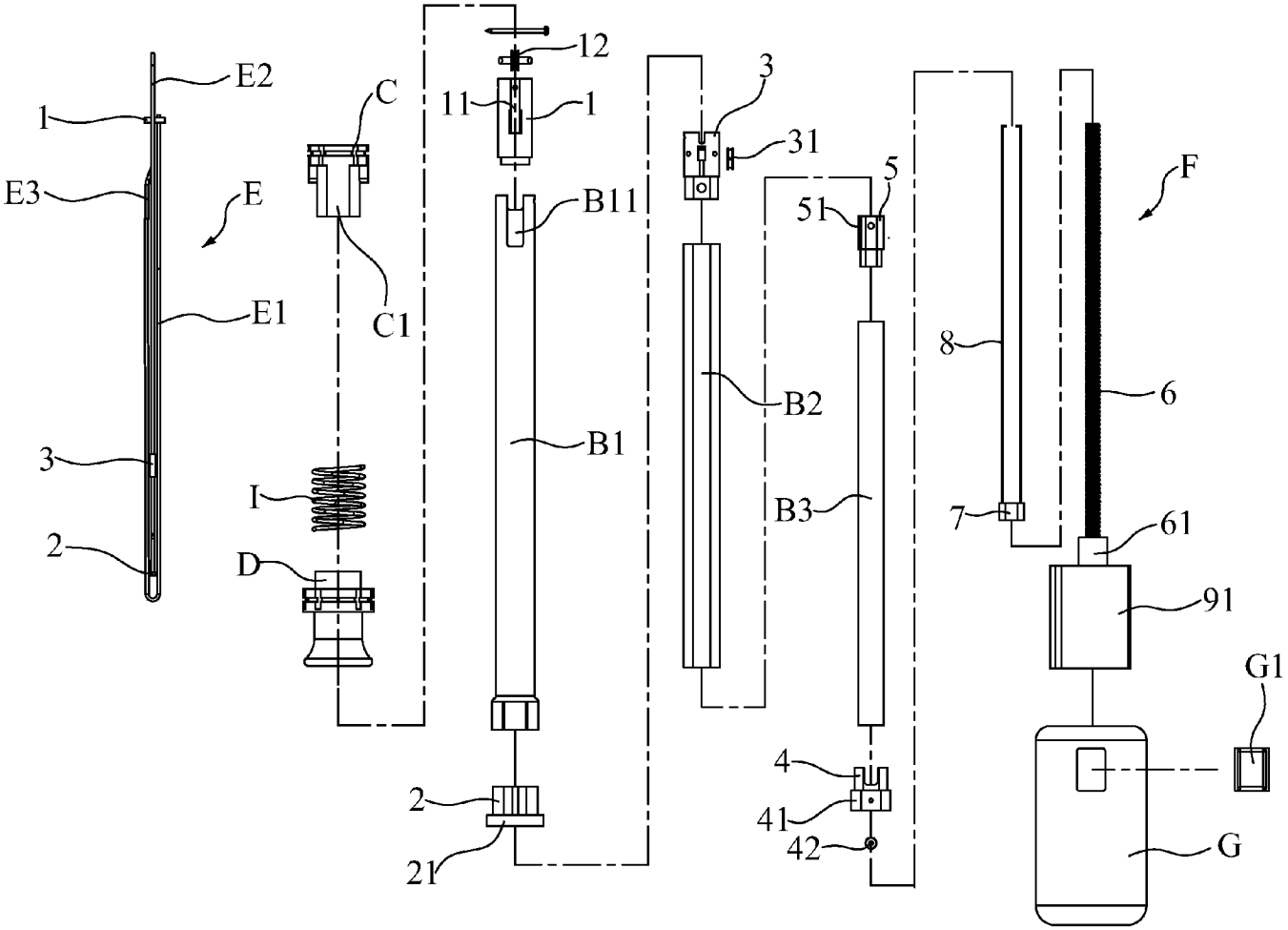
Figure 4:
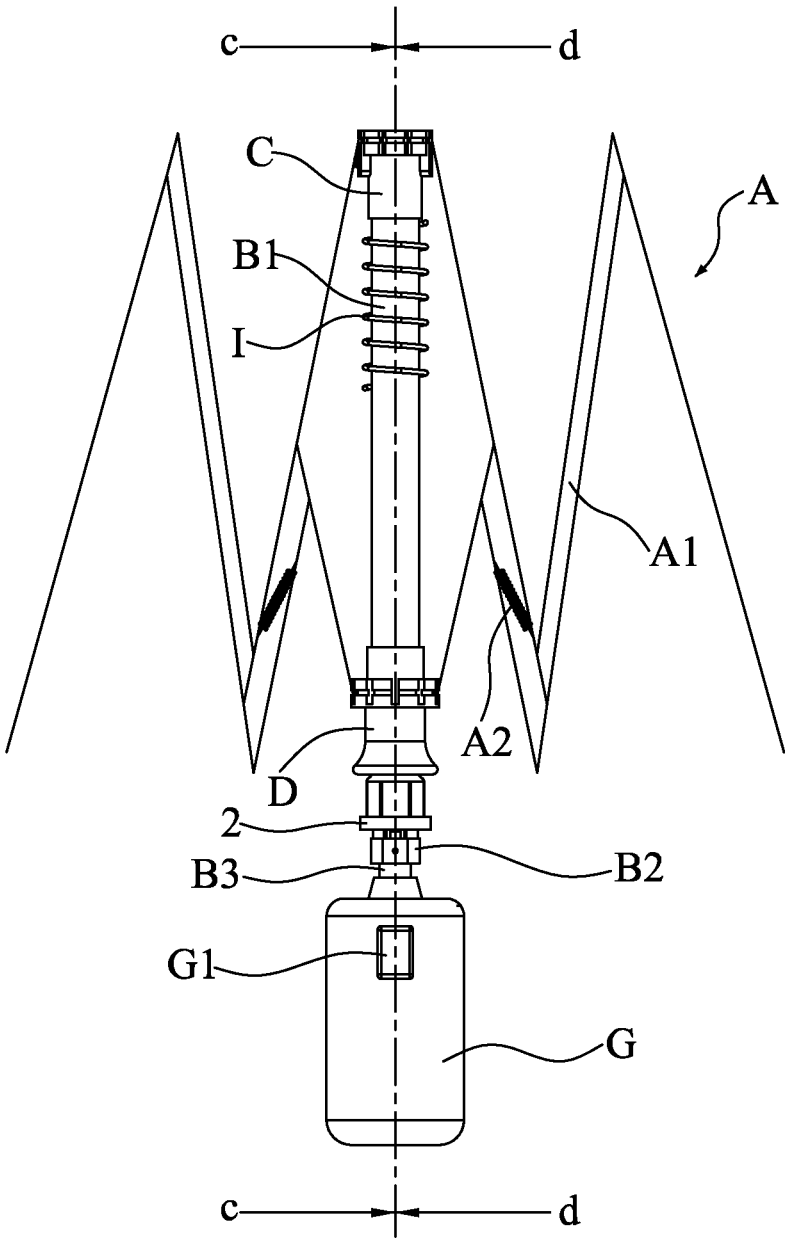
Figure 4A:
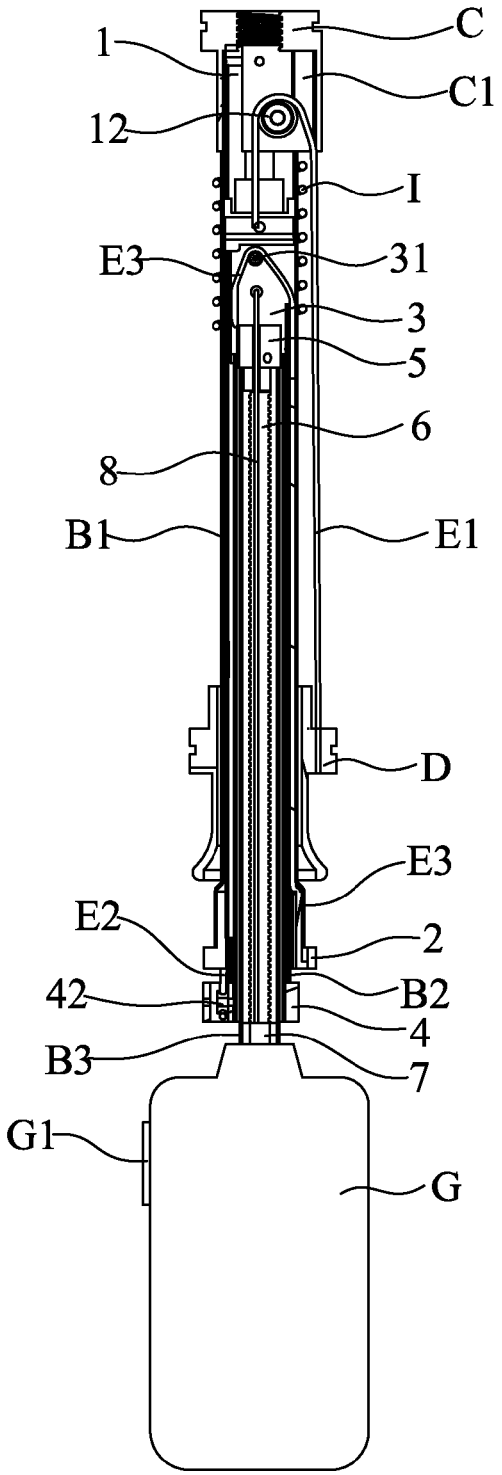
FIG. 4*a* is a sectional view taken along line a-a of FIG. 4.
Figure 4B:
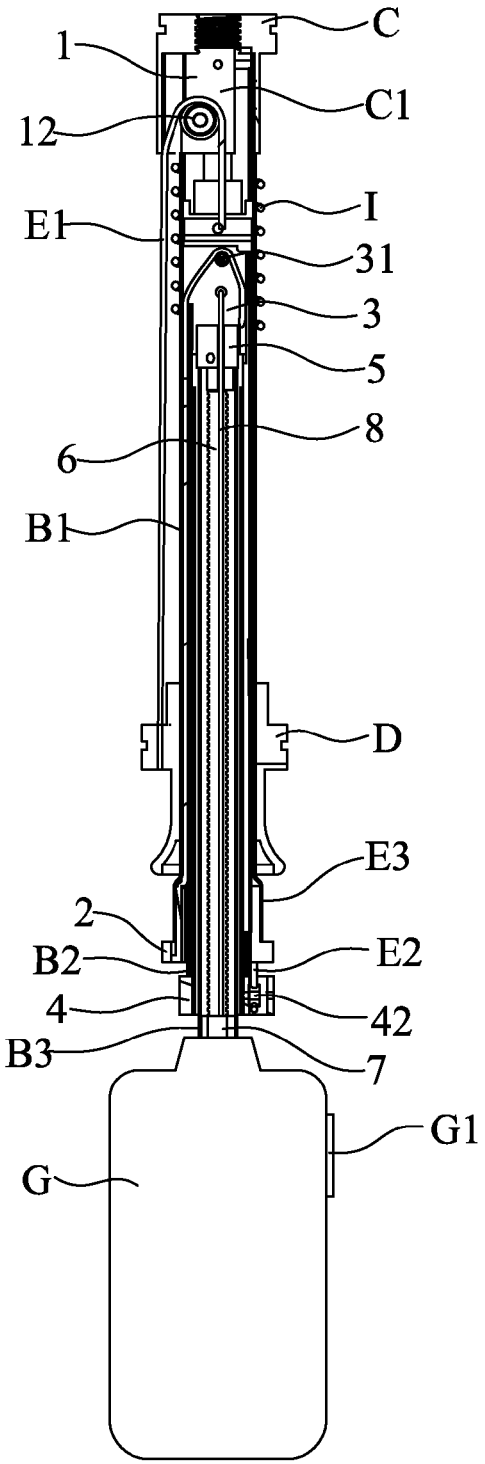
FIG. 4*b* is a sectional view taken along line b-b of FIG. 4.
Figure 5:
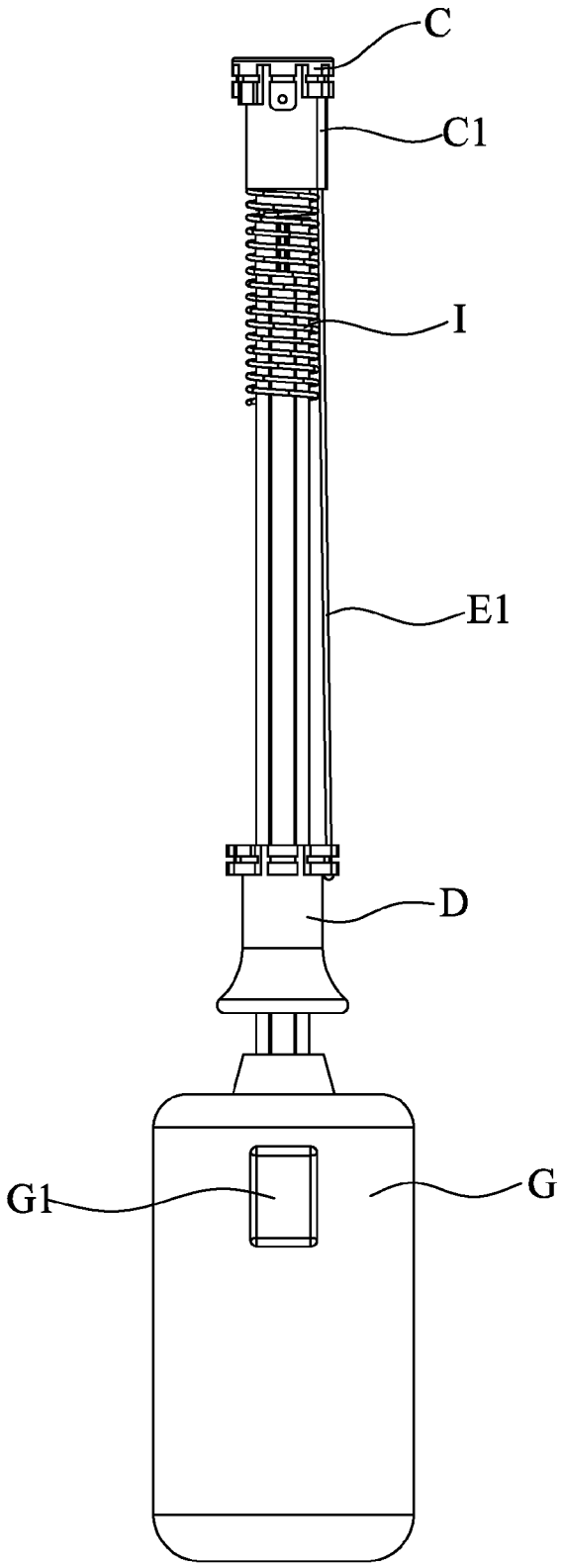
Figure 6:
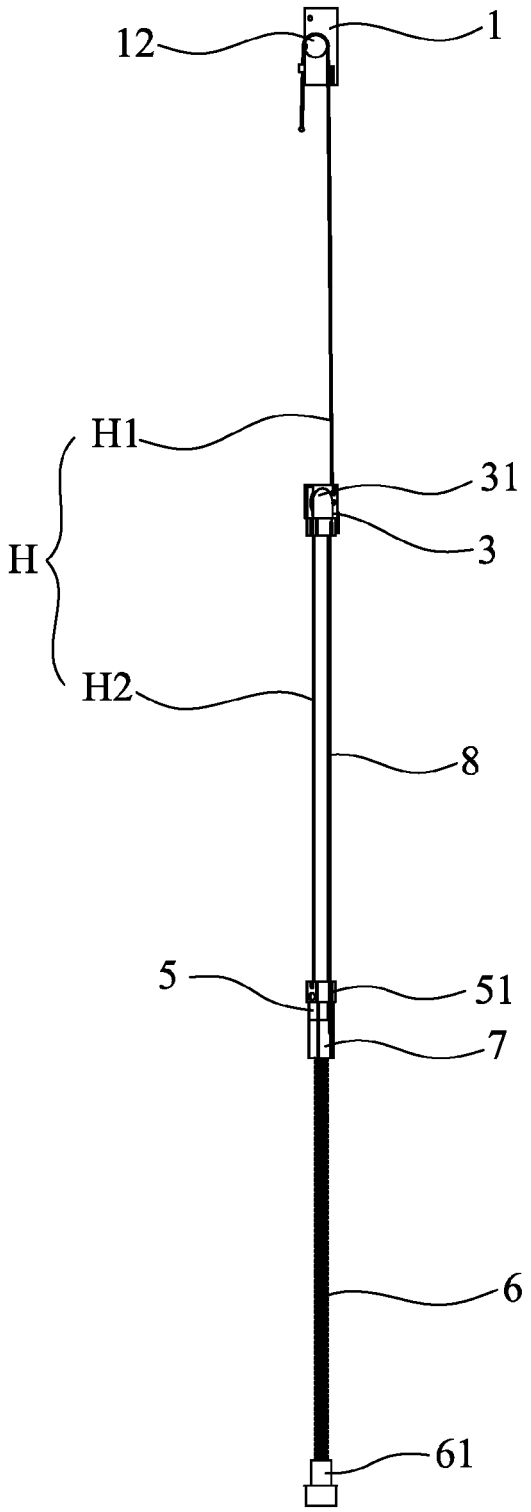
FIG. 6 is a first structural schematic view showing the umbrella of the second embodiment of the present invention in an unfolded state.
Figure 7:
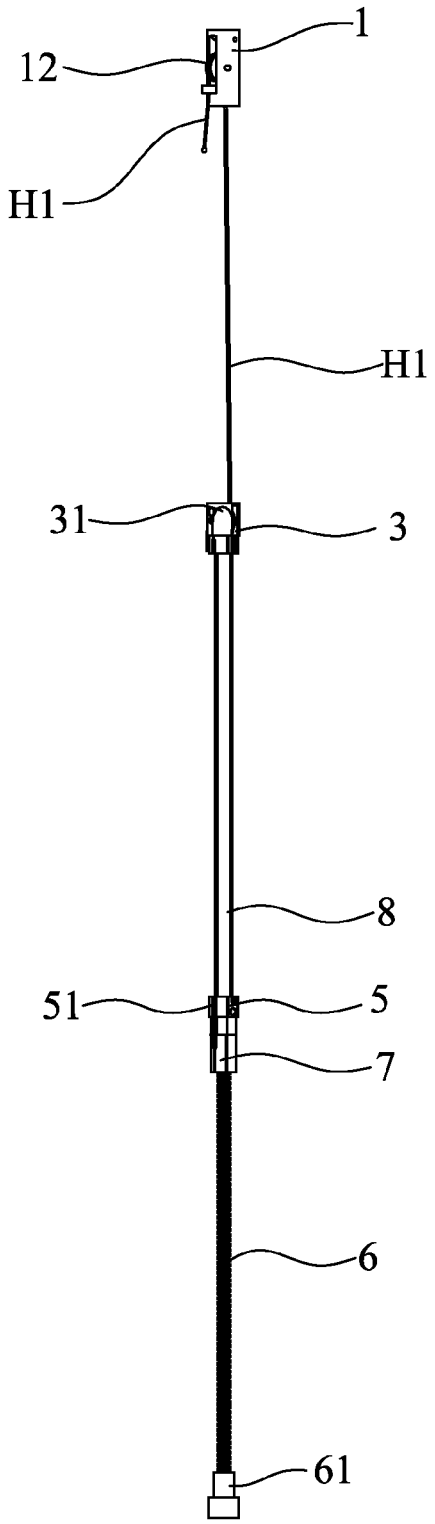
FIG. 7 is a second structural schematic view showing the umbrella of the second embodiment of the present invention in an unfolded state.
Figure 8:
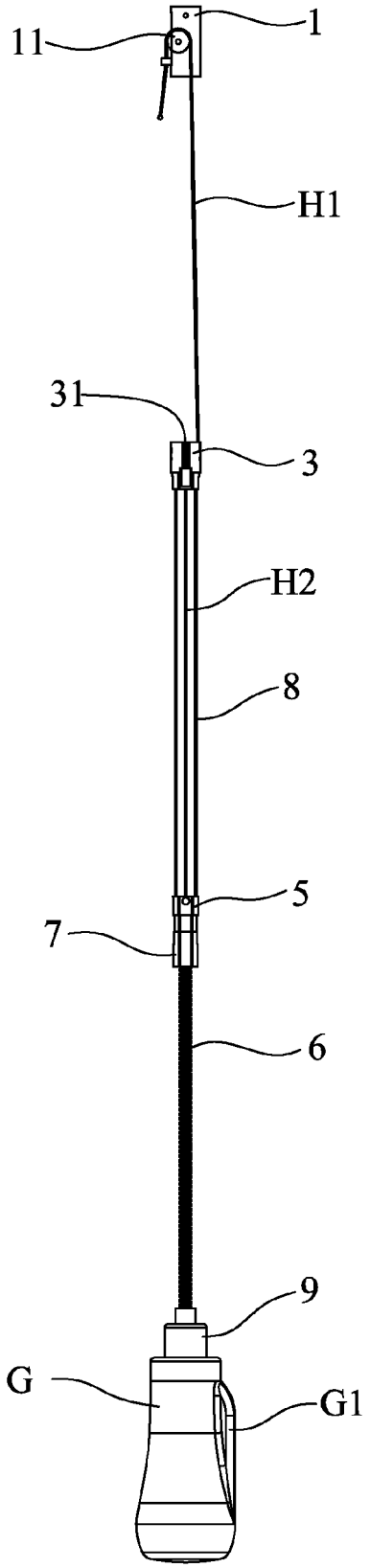
FIG. 8 is a third structural schematic view showing the umbrella of the second embodiment of the present invention in an unfolded state.
Figure 9:
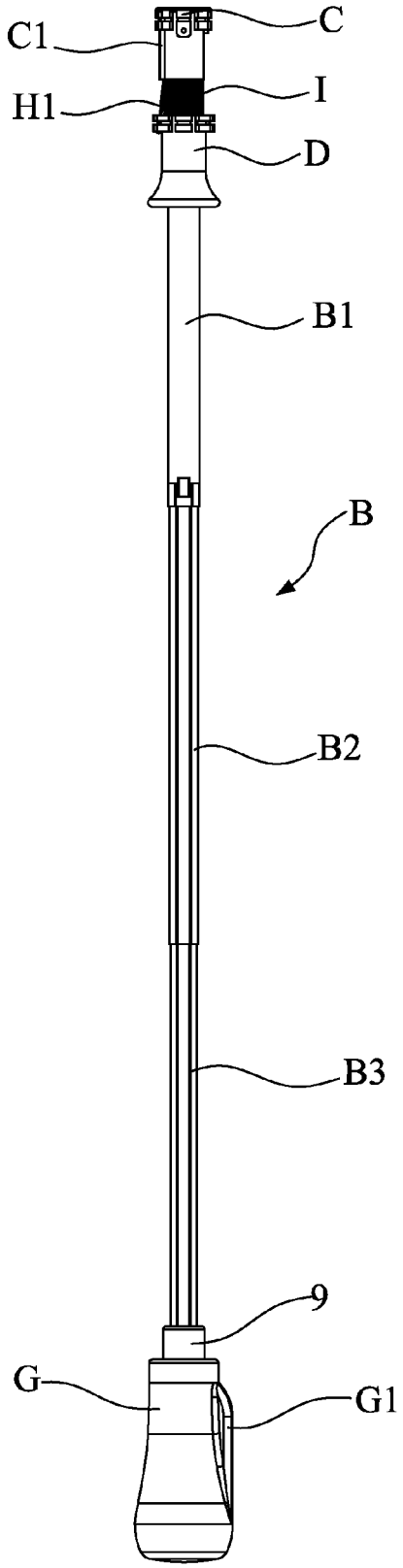
FIG. 9 is a fourth structural schematic view showing the umbrella of the second embodiment of the present invention in an unfolded state.
Figure 10:
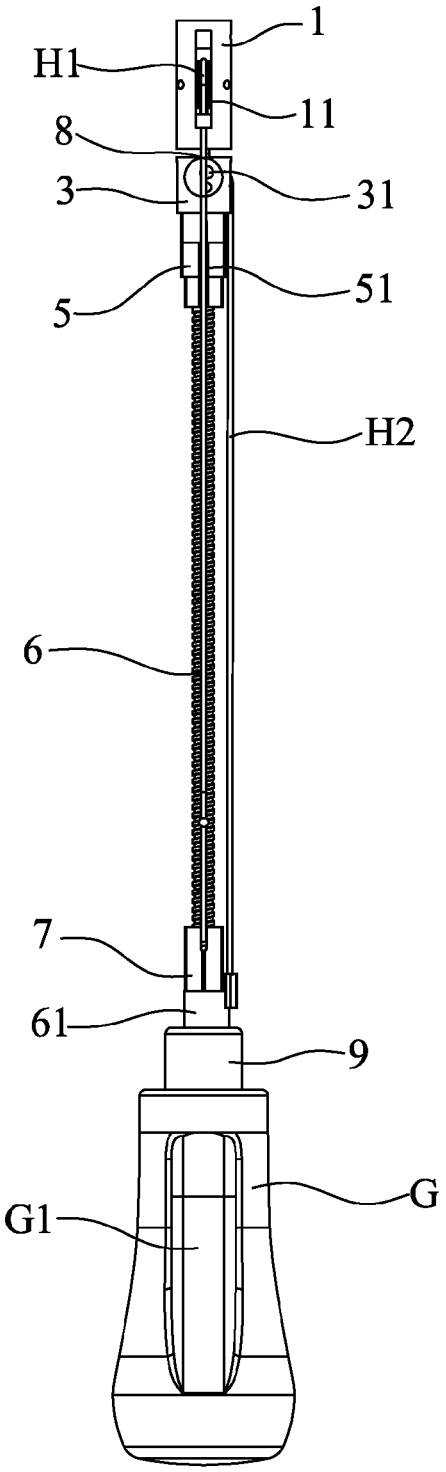
FIG. 10 is a first structural schematic view showing the umbrella of the second embodiment of the present invention in a folded state.
Figure 11:
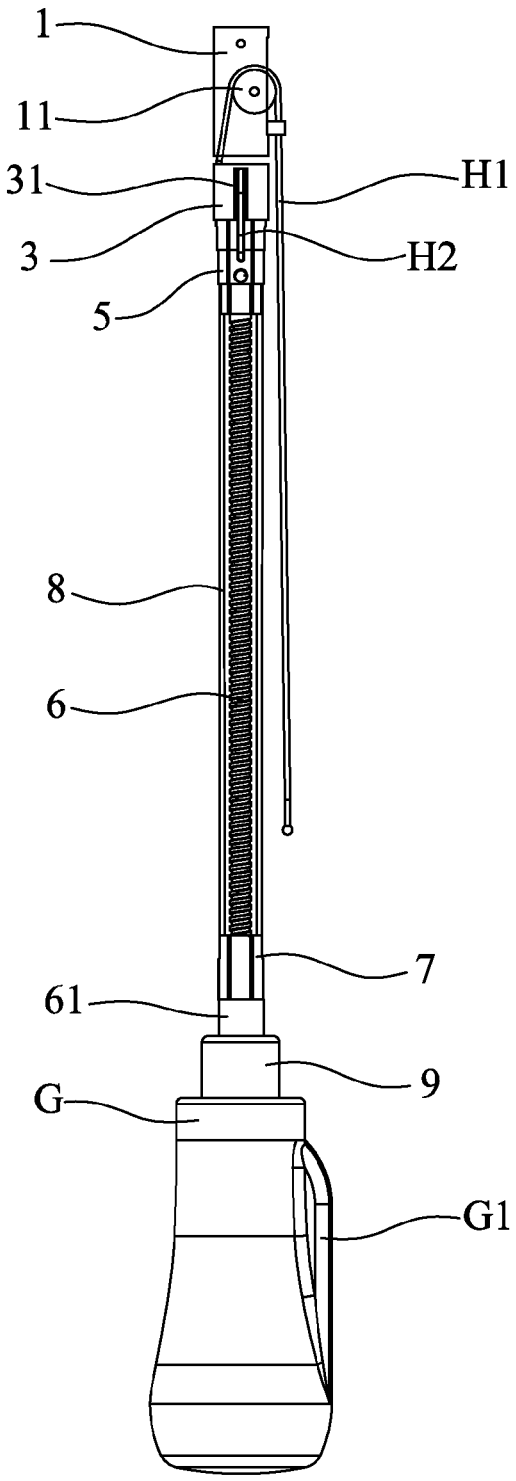
FIG. 11 is a second structural schematic view showing the umbrella of the second embodiment of the present invention in a folded state.
Figure 12:
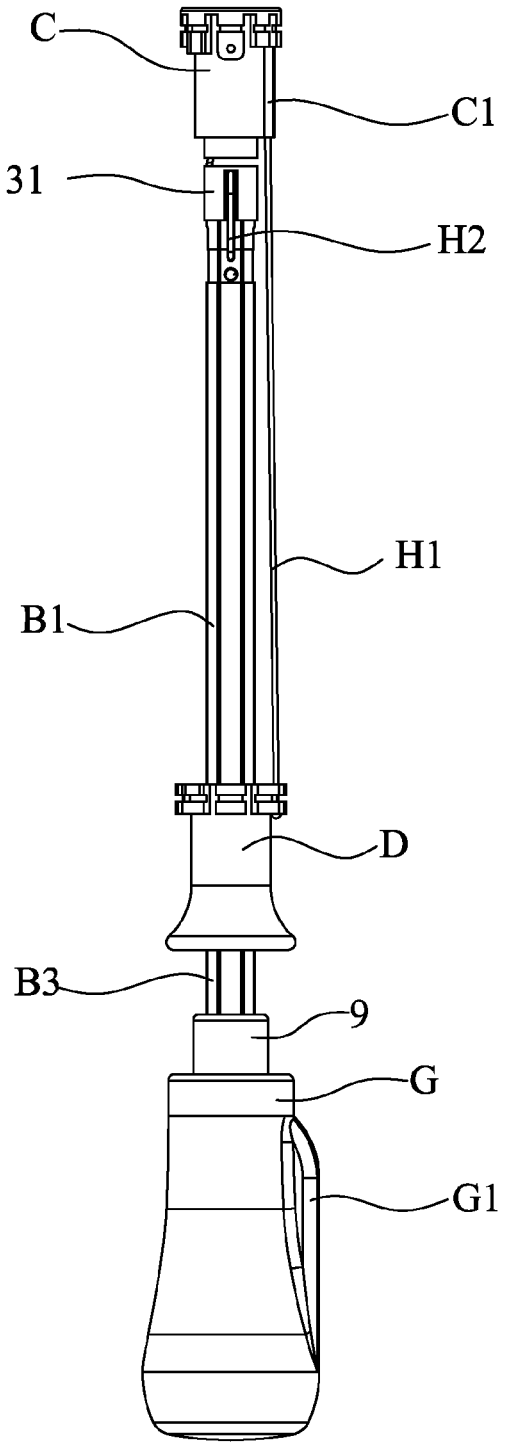
FIG. 12 is a third structural schematic view showing the umbrella of the second embodiment of the present invention in a folded state.
Figure 13:
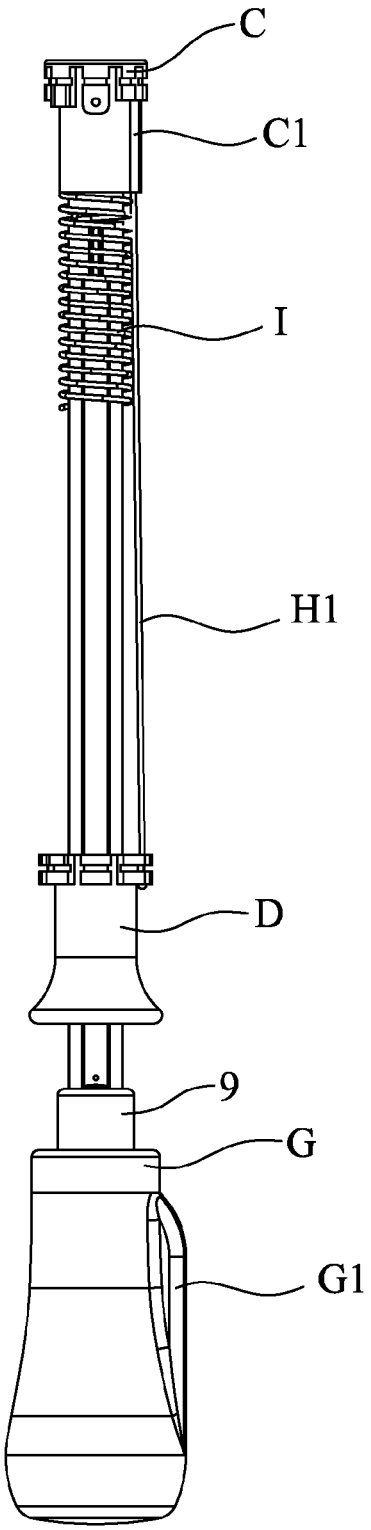
FIG. 13 is a fourth structural schematic view showing the umbrella of the second embodiment of the present invention in a folded state.

As shown in FIG. 4, FIG. 4*a*, FIG. 4*b*, when the user wants to fold the umbrella, the button G1 of the umbrella handle G is pressed to start the power source 9 to output a power to turn reversely. The power source 9 will drive the bolt 6 to turn reversely, and the nut 7 will be moved downward along the bolt 6. When the nut 7 is moved downward, the bolt 6 will use the push rod 8 to bring the middle sleeve plug 3, and the nut 7 will bring the bolt 6 to move downward relative to the inner sleeve B3 so as to pull the middle sleeve B2 to move downward relative to the inner sleeve B3. At the same time, the lower nest D biased by the auxiliary spring I will be moved downward along the outer sleeve B1. When the middle sleeve B2 is moved downward, the distance between the middle sleeve fixing ring 4 and the upper end of the inner sleeve B3 will be lengthened. The transformation ratio pull rope E2 will pull the outer sleeve plug 1 to bring the outer sleeve B1 to move downward relative to the middle sleeve B2. The lower nest pull rope E1 connected on the middle sleeve plug 3 will release the lower nest D and the lower nest D will move downward along the outer sleeve B1. The umbrella frame A is folded by the function of the springs A and the umbrella cloth, such that the umbrella is folded completely. During the operation to fold the umbrella, the transformation ratio pull rope E2 and the lower nest pull rope E1 are mainly to fold the umbrella. The inner sleeve pull rope E3 is for the change of the lengthened distance between the outer sleeve fixing ring 2 and the middle sleeve plug 3 as well as the shortened distance between the middle sleeve plug 3 and the upper end of the inner sleeve B3.

As shown in FIG. 6 to FIG. 13, in a second embodiment of the present invention, the umbrella opening/closing transformation ratio mechanism H comprises a lower nest pull rope H1 and a middle sleeve pull rope H2. One end of the lower nest pull rope H1 is connected to the middle sleeve plug 3, and the other end of the lower nest pull rope H1 is inserted through the outer sleeve plug 1, passes through the outer sleeve pulley 12 and extends out of the outer sleeve B1 to be fixed to the lower nest D. One end of the middle sleeve pull rope H2 is connected to the inner sleeve plug 5, and the other end of the middle sleeve pull rope H2 passes through the middle sleeve pulley 31 of the middle sleeve plug 3 to be fixed to the lower end of the outer sleeve B1.

As shown in FIG. 6 to FIG. 9, when the user wants to unfold the umbrella, the button G1 of the umbrella handle G is pressed to start the power source 9 to output a power to turn clockwise. The power source 9 will drive the bolt 6 to turn, and the nut 7 will be moved upward along the bolt 6. When the nut 7 is moved upward, the bolt 6 will use the push rod 8 to push the middle sleeve plug 3 to move the middle sleeve B2 upward. The middle sleeve B2 is pushed to unfold upward relative to the inner sleeve B3. When the middle sleeve B2 is moved upward, the distance between the middle sleeve plug 3 and the inner sleeve plug 5 will be lengthened. The other end of the middle sleeve pull rope H2 will pull the outer sleeve B1 to move upward relative to the middle sleeve B2 to supplement the change of the distance, namely, the outer sleeve B1 is pushed to unfold relative to the middle sleeve B2. At this moment, the distance between the outer sleeve plug 1 and the middle sleeve plug 3 is lengthened. The lower nest pull rope H1 will pull the lower nest D to move upward relative to the outer sleeve B1 to supplement the change of the distance. The lower nest D is moved upward to unfold the umbrella frame A. In this way, the umbrella is unfolded completely.

As shown in FIG. 10 to FIG. 13 and referring to FIG. 4, when the user wants to fold the umbrella, the button G1 of the umbrella handle G is pressed to start the power source 9 to output a power to turn reversely. The power source 9 will drive the bolt 6 to turn reversely, and the nut 7 will be moved downward along the bolt 6. When the nut 7 is moved downward, the bolt 6 will use the push rod 8 to bring the middle sleeve plug 3 and the middle sleeve B2 to move downward. The middle sleeve B2 is moved downward relative to the inner sleeve B3. When the middle sleeve B2 is moved downward, the distance between the middle sleeve plug 3 and the inner sleeve plug 5 will be shortened. The other end of the middle sleeve pull rope H2 will bring the outer sleeve B1 to move downward relative to the middle sleeve B2 to supplement the change of the distance. The outer sleeve B1 is moved downward relative to the middle sleeve B2. At the same time, the lower nest D biased by the auxiliary spring I will be moved downward along the outer sleeve B1. The umbrella frame A is folded by the function of the springs A and the umbrella cloth. The distance between the outer sleeve plug 1 and the middle sleeve plug 3 is shortened, and the lower nest pull rope H1 is brought by the lower nest D to supplement the change of the distance. In this way, the umbrella is folded completely.

Referring to FIG. 1-1 and FIG. 1-2, the middle sleeve plug 3 of the aforesaid two embodiments is made of a metallic material or a plastic material. The middle sleeve plug 3 has a hanging hole 32 to cooperate with the push rod 8. When the middle sleeve plug 3 is made of a plastic material, the hanging hole 32 is provided with a metallic ring 33 therein for the push rod 8 and the hanging hole 32 to have a long service life. The bent portion of the push rod 8 is contact with the metallic ring 33 to prevent the push rod 8 and the hanging hole 32 from wearing each other to enlarge the gap. The push rod 8 may be broken easily because the gap is gradually enlarged. The middle sleeve plug 3 further has a fixing hole 34 to fix the full rope, and cooperates with a metallic pipe 35 which has a guide curved edge at one end surface thereof to prevent the pull rope from being cut off by the fixing hole 34 so as to ensure the service life of the pull rope.

Referring to FIG. 1-3 and FIG. 1-4, the inner sleeve plug 5 may be made of a metallic material or a plastic material. The inner sleeve plug 5 has a fixing hole 52 for insertion of the pull rope. When the inner sleeve plug 5 is made of a plastic material, the fixing hole 52 cooperates with a metallic pipe 53 having a guide curved edge at one end surface thereof to prevent the pull rope from being cut off by the fixing hole 52 so as to ensure the service life of the pull rope. One side wall of the inner sleeve plug 5 is directly formed with a trough 54 to cooperate with the upper end of the inner sleeve B3 so as to form a receiving space for a concave point B31 of the inner sleeve B3.

Referring to FIG. 1-5, the lower end of the bolt 6 is provided with a soft cushion 61 located above the power source 9. The soft cushion 61 may be a rubber sleeve or a plastic cushion to prevent the nut 7 from hitting the output shaft of the power source 9 when the nut 7 is moved to the lower end of the bolt 6, providing a buffer function.

Accordingly, the middle rod set B of the present invention is provided with the umbrella opening/closing transformation ratio mechanism E, F composed of two or three pull ropes. The two or three pull ropes are connected with the sleeves of the middle rod set B as well as the upper nest C and the lower nest D, respectively, and cooperate with the power source 9 in the umbrella handle G to drive the bolt 6 to turn. When the nut 7 on the bolt 6 is moved up and down, the push rod 8 is pushed to bring the middle sleeve B2 to move up and down relative to the inner sleeve B3 to open/close the sleeves of the middle rod set B and the umbrella cloth. The multi-folded umbrella can be folded or unfolded completely for people to use the umbrella conveniently and quickly.

What is claimed is:

1. A control mechanism of a full-automatic multi-folded umbrella, disposed between an umbrella handle and a middle rod set for controlling an umbrella opening/closing transformation ratio mechanism, the middle rod set comprising at least three sleeves, including an outer sleeve, a middle sleeve and an inner sleeve; a top end of the middle rod set being connected with an upper nest, a lower nest being fitted on the middle rod set; the control mechanism comprising a bolt, a nut and a push rod disposed on the bolt and cooperating with the bolt, the push rod being connected with the nut and a top end of the middle sleeve, a lower end of the bolt being driven by a power source in the umbrella handle to turn clockwise or counterclockwise for the nut to be moved up and down along the bolt; the power source being controlled by a button on the umbrella handle, wherein an upper end of the outer sleeve of the middle rod set is provided with an outer sleeve pulley, an outer sleeve fixing ring being fixed to a lower end of the outer sleeve to cooperate with the outer sleeve, an outer sleeve plug has a central through hole; a middle sleeve plug with a middle sleeve pulley fixed to the top end of the middle sleeve, a middle sleeve fixing ring fixed to a lower end of the middle sleeve, an outer side of the middle sleeve fixing ring provided with a middle sleeve fixing ring pulley; a lower end of the inner sleeve being fixed to the umbrella handle; and the middle sleeve plug is made of a plastic material with a hanging hole to cooperate with the push rod, the hanging hole being provided with a metallic ring therein; the middle sleeve plug further having a fixing hole to fix a pull rope and cooperate with a metallic pipe, the metallic pipe having a guide curved edge at one end surface thereof.

2. The control mechanism of a full-automatic multi-folded umbrella as claimed in claim 1, wherein an outer sleeve plug is fixed inside an upper end of the outer sleeve, the outer sleeve plug having a central through hole, an outer sleeve pulley being provided at an upper portion of the outer sleeve plug, the outer sleeve being formed with a notch corresponding in position to the outer sleeve pulley.

3. The control mechanism of a full-automatic multi-folded umbrella as claimed in claim 2, wherein the upper nest is secured to a top end of the outer sleeve, a lower portion of the upper nest being fitted on the outer sleeve and formed with a lid groove corresponding in position to the notch of the outer sleeve.

4. The control mechanism of a full-automatic multi-folded umbrella as claimed in claim 1, wherein an inner sleeve plug is fixed to a top portion of the inner sleeve, the inner sleeve plug being made of a plastic material, the inner sleeve plug having a fixing hole for insertion of a pull rope and cooperating with a metallic pipe having a guide curved edge at one end surface thereof.

5. The control mechanism of a full-automatic multi-folded umbrella as claimed in claim 1, wherein one side wall of an inner sleeve plug is directly formed with a trough to cooperate with an upper end of the inner sleeve so as to form a receiving space for a concave point of the inner sleeve.

6. The control mechanism of a full-automatic multi-folded umbrella as claimed in claim 1, wherein the lower end of the bolt is provided with a soft cushion located above the power source.

7. The control mechanism of a full-automatic multi-folded umbrella as claimed in claim 1, wherein a lower end of the upper nest is connected with an auxiliary spring fitted on the outer sleeve.

8. The control mechanism of a full-automatic multi-folded umbrella as claimed in claim 1, wherein the push rod is a pair of symmetrical hard rod members, and two sides of an inner sleeve plug are formed with guide grooves.

9. The control mechanism of a full-automatic multi-folded umbrella as claimed in claim 1, wherein the push rod is a hard pipe.

10. The control mechanism of a full-automatic multi-folded umbrella as claimed in claim 1, wherein the power source is a motor.

11. The control mechanism of a full-automatic multi-folded umbrella as claimed in claim 1, wherein the umbrella opening/closing transformation ratio mechanism comprises a lower nest pull rope, a transformation ratio pull rope, and an inner sleeve pull rope; one end of the lower nest pull rope being fixed to the middle sleeve plug, another end of the lower nest pull rope passing through the outer sleeve and winding though the outer sleeve pulley to be fixed to the lower nest; one end of the transformation ratio pull rope being fixed to an upper end of the inner sleeve, another end of the transformation ratio pull rope passing through the bottom of the middle sleeve and winding through a middle sleeve fixing ring pulley of a middle sleeve fixing ring and entering the middle sleeve to extend out of an upper end of the middle sleeve and entering the outer sleeve to extend out of an upper end of the outer sleeve to be fixed to the top of the outer sleeve; one end of the inner sleeve pull rope being fixed to the upper end of the inner sleeve, another end of the inner sleeve pull rope passing through the middle sleeve and winding through the middle sleeve fixing ring pulley of the middle sleeve plug and entering the position between the middle sleeve and the outer sleeve to be fixed to a lower end of the outer sleeve.

12. The control mechanism of a full-automatic multi-folded umbrella as claimed in claim 11, wherein the transformation ratio rope and the inner sleeve pull rope are the same rope.

13. The control mechanism of a full-automatic multi-folded umbrella as claimed in claim 1, wherein the umbrella opening/closing transformation ratio mechanism comprises a lower nest pull rope and a middle sleeve pull rope, one end of the lower nest pull rope being connected to the middle sleeve plug, another end of the lower nest pull rope passing through an outer sleeve pulley and extending out of the outer sleeve to be fixed to the lower nest; one end of the middle sleeve pull rope being connected to an inner sleeve plug, another end of the middle sleeve pull rope passing through the middle sleeve fixing ring pulley of the middle sleeve plug to be fixed to a lower end of the outer sleeve.

* * * * *